US005994281A

United States Patent [19]

He et al.

[11] Patent Number: 5,994,281

[45] Date of Patent: Nov. 30, 1999

[54] BAR COMPOSITIONS CONTAINING SOLID AMPHOTERIC SURFACTANTS

[75] Inventors: Mengtao He, Wayne; Michael Fair, Hackensack, both of N.J.

[73] Assignee: Unilever Home & Personal Care USA, Division of Conopco, Inc., Greenwich, Conn.

[21] Appl. No.: 09/238,542

[22] Filed: Jan. 28, 1999

[51] Int. Cl.[6] ..... C11D 1/94; C11D 1/04; C11D 1/12; C11D 1/88

[52] U.S. Cl. ..... 510/152; 510/141; 510/155; 510/451

[58] Field of Search ..... 510/141, 152, 510/155, 490, 450, 451

[56] References Cited

U.S. PATENT DOCUMENTS

| | | | |
|---|---|---|---|
| 3,442,812 | 5/1969 | Barnhurst | 510/150 |
| 3,689,437 | 9/1972 | McLaughlin | 252/557 |
| 3,962,418 | 6/1976 | Birkofer | 510/124 |
| 4,080,310 | 3/1978 | Ng et al. | 510/123 |
| 4,207,198 | 6/1980 | Kenkare | 510/145 |
| 4,328,131 | 5/1982 | Carson, Jr. et al. | 252/542 |
| 5,786,312 | 7/1998 | Post et al. | 510/152 |

*Primary Examiner*—Yogendra Gupta
*Assistant Examiner*—Christine E. Ingersoll
*Attorney, Agent, or Firm*—Ronald A. Koatz

[57] ABSTRACT

The present invention relates to personal wash bar compositions, particularly compositions comprising (1) lathering anionic surfactants (e.g., sodium acyl isethionate or fatty acid soap); (2) specific solid, less hygroscopic amphoteric surfactants (e.g., disodium N-lauryl iminodipropionate). The invention relates to the incorporation of significant levels of said solid amphoteric surfactant into the specific bar compositions to achieve superior skin mildness and bar user properties. The invention especially addresses the advantages of using solid, less hygroscopic amphoteric surfactants to reduce the processing difficulties in extrusion and modified extrusion processes.

31 Claims, 5 Drawing Sheets

BAR COMPOSITIONS CONTAINING SOLID AMPHOTERIC SURFACTANTS

FIELD OF THE INVENTION

The present invention relates to personal wash bar compositions particularly those made by extrusion process, comprising (1) lathering anionic surfactants (e.g., sodium acyl isethionate; and (2) solid amphoteric surfactants having specifically defined physical parameters (e.g., disodium N-lauryl iminodipropionate). The invention further relates to the incorporation of significant levels of said amphoteric surfactants into specific bar compositions. Through careful balancing of the weight ratios among surfactants, structurants/fillers and emollients, said bars can be successfully processed using extrusion technology to obtain high finishing quality (e.g., satisfactory bar hardness and lather). Specifically, the invention relates to incorporating said amphoteric surfactant in personal washing bars to reduce the processing difficulties (e.g., reducing mixing and drying time and reducing tackiness during extrusion). The solid amphoteric surfactants in the bars also help to achieve superior skin mildness when compared to bars containing other types of amphoteric surfactants. Finally, the invention teaches specific approaches for handling the solid amphoteric surfactants during bar processing.

BACKGROUND

Anionic surfactants have been utilized as the major actives in many skin cleansers. Notwithstanding their many advantages (e.g., having good lathering properties), they tend to irritate skin. For example, irritated and cracked skin often result from the use of fatty acid soap, especially in colder climates. One method of reducing the harshness of anionic surfactants in general (including fatty acid soap) is to utilize other surfactants, such as amphoteric surfactants, as coactives to partially replace anionic surfactants in skin cleansing products. While not wishing to be bound by theory, it is believed that amphoterics reduce the skin irritation by forming colloid aggregates (micelles, vesicles and liquid crystals) with the skin-irritating anionics in aqueous personal washing liquor, which hinders the penetration and binding of the anionic surfactants to the skin proteins.

The use of amphoteric surfactants in solid, skin cleansing bars, however, can introduce problems in bar processing and user properties. For example, introducing 10% to 15% wt. of cocoamidopropyl betaine (a commonly used amphoteric surfactant) to an extruded synthetic surfactant bar results in a formulation which is sticky and thereby severely slows down the extrusion throughput. Including the same level of cocoamidopropyl betaine in a fatty acid soap based bar increases time cycles in mixing and drying. Most amphoteric surfactants are sticky (gelish) and sensitive to work (e.g., thinning/gelling in response to shear). These properties slow down or even stop the extrusion/plodding, cause stickiness to the stamping die, and tend to give undesired mushiness and softness to bars. Further, many of these amphoteric surfactants are difficult to dry into low moisture solids (e.g., powders or pellets). Therefore they are commercially supplied in the form of diluted aqueous solutions, which brings in extra amount of water into the mixer and lengthens the mixing-drying time.

There is thus a need in the art for amphoteric surfactants that are non-sticky, have a low moisture solid state, can be used to reduce the mixing/drying cycle, and can be continuously processed by the extrusion/plodding technology at high throughput. High levels of said amphoteric surfactant should be able to be incorporated into extruded bars (containing either synthetic surfactants or fatty acid soap or mixtures thereof) without causing processing difficulties and negatively affecting bar user properties such as lather and bar hardness. Preferably, bar user properties (e.g., lather) should be enhanced by the inclusion of said amphoteric surfactant.

It is also desirable to identify amphoteric surfactants which may be more efficient than other amphoterics in reducing skin irritation caused by the anionic surfactants or fatty acid soap in bars.

It should be noted that bars containing synthetic surfactants have a different formulation space when compared with fatty acid soap bars. While bars containing synthetic surfactants require additional structurants such as fatty acids and waxes, fatty acid soap bars do not. The processing procedures for synthetic surfactant bars and fatty acid soap bars also have many differences, as described in many patents covering the field.

Therefore, identifying an amphoteric surfactant that simultaneously meets the needs listed above for both synthetic and fatty acid soap bars is extremely technically challenging. Unexpectedly, however, applicants have found that amphoterics defined by certain physical parameters meet these needs.

The use of solid amphoteric surfactants (e.g., disodium N-lauryl iminodipropionate) in bar and liquid compositions is not itself new. This amphoteric surfactant, for example, has been incorporated in acidic, low pH bars containing synthetic anionic surfactants. The disodium N-lauryl iminodipropionate was applied to elastic, rubbery bars prepared using a cast melt process. It has also generally been used as a mild detergent in liquid cleansers (e.g., shampoos and liquid body washes).

U.S. Pat. No. 3,442,812 to J. Barnhurst et al. (assigned to Colgate-Palmolive Co.) teaches a non-soap, synthetic detergent bar with an acidic lather having skin conditioning effects. The bar lather has to be acidic with pH less than 6 (i.e., pH at 5 or below as described in column 2, line 42–68, and claim 1, 12, 13 of said patent). Disodium N-lauryl iminodipropionate is cited as one of the amphoteric surfactants used. The patent did not recognize the criticality of using a solid amphoteric surfactant in bar formulations to improve the processing. Further, it does not recognize the superiority of disodium N-lauryl iminodipropionate (or other amphoterics having physical parameters defined by the subject invention) when compared with other amphoterics in reducing the skin irritation caused by anionics. The requirement for low pH also prevents the use of fatty acid soap (pH>7) as the bar ingredients in this application. By contrast, the amphoterics defined by the subject invention (e.g., disodium N-lauryl iminodipropionate) can be used as solid coactives in both fatty acid soap and synthetic surfactant based extrusion bars. The bars of the invention must have a neutral or basic pH (i.e., between 6 and 12, preferably between 6 and 10, and most preferably between 6.5 and 9). The subject application teaches the use of these solid amphoteric surfactant to (1) achieve processing improvements; (2) achieve superior skin mildness as compared with other amphoteric surfactants. These attributes are neither taught nor suggested in the referred patent.

U.S. Pat. No. 4,080,310 to L. Ng et al. (assigned to Beecham Group, Ltd.) teaches an amphoteric conditioning shampoo, which contains 5 to 50% w/w of amphoteric detergent as sole detergent and 0.5 to 3.0% w/w of cationic or quaternary resin. The pH is from 3 to 9, preferably 4 to 7. The amphoteric detergent may be, for example, an N-alkyl-.beta.-aminopropionate or N-alkyl-.beta.-iminodipropionate. Suitable resins are cationic polyamide polymers or a cationic starch or cellulose derivatives. Said patent does not teach the use of solid amphoterics as defined (e.g., disodium N-lauryl iminodipropionate) in skin cleansing bars for the advantages of processing and simultaneously reducing the anionic irritation. In contrast, in the subject application, disodium N-lauryl iminodipropionate is incorporated in synthetic surfactant and/or fatty acid soap based extrusion bars to (1) facilitate the bar processing; (2) enhance the mildness of the bar formulation; and (3) enhance the creaminess of the bar lather performance.

U.S. Pat. No. 4,207,198 to D. Kenkare (assigned to Colgate-Palmolive Company) teaches an elastic detergent bar of improved form-retaining ability during elevated temperature storage and of improved foaming power. The bar comprises an organic detergent, which is an ammonium or lower alkanol-ammonium anionic organic detergent salt, or a mixture of such anionic detergent with amphoteric synthetic organic detergent, gelatin and a lower di- or polyhydric alcohol. The amphoteric detergents claimed include N-alkyl-.beta.-iminodipropionate. The bars are prepared by a cast-melt method and display an extensive degree of elasticity. The rubbery bar is described in the claim 1 as "2 cm thickness thereof can be pressed between a thumb and forefinger to a 1 cm thickness and upon release of such pressure will return within five seconds to within 1 mm of the 2 cm thickness". In contrast, the amphoterics of the subject invention (e.g., disodium N-lauryl iminodipropionate) are used in bars prepared by the extrusion method, which requires extrudate having rigidity and solid nature. Most importantly, incorporating the solid amphoteric surfactant in the extrusion bars help reduce the bar softness and elasticity. Therefore the referred patent teaches away from the art of the subject application.

U.S. Pat. No. 4,328,131 to J. Carson et al. (assigned to Colgate-Palmolive Company) teaches an elastic, rubber-like detergent bar (described as "2 cm thickness thereof can be pressed between a thumb and forefinger to a 1 cm thickness and upon release of such pressure will return within five seconds to within 1 mm of the 2 cm thickness" in the claim 1) of improved elevated temperature stability, so that it better maintains its shape on storage at temperatures somewhat higher than normal, includes an amphoteric synthetic organic detergent in mixture with an anionic synthetic organic detergent, gelatin, water and insoluble gas in very small bubble form distributed throughout the bar. The amphoteric surfactants used include disodium N-alkyl-.beta.-iminodipropionate. Bars are prepared by the cast-melt method. In contrast, disodium N-lauryl iminodipropionate is used by the subject application in bars prepared by the extrusion method, which requires extrudate having rigidity and solid nature. Most importantly, incorporating the solid amphoteric surfactant in the extrusion bars is for reducing the bar softness and elasticity. Therefore the referred patent teaches away from the art of the subject application.

U.S. Pat. No. 3,962,418 filed to R. Birkofer teaches a mild, thickened liquid shampoo composition with conditioning properties comprising 4–8% anionic surfactants, zwitterionic and amphoteric surfactants, polyethoxylated nonionic surfactants and a cationic cellulose ether thickening and conditioning agent. The amphoteric surfactants used include disodium N-alkyl-.beta.-iminodipropionate. However, said patent does not teach the use of solid disodium N-lauryl iminodipropionate in solid skin cleansing bars for the advantages of bar processing and simultaneously reducing the skin irritation. In contrast, in the subject application, disodium N-lauryl iminodipropionate is incorporated in synthetic surfactant and/or fatty acid soap based extrusion bars to simultaneously facilitate the bar processing, enhance the mildness of the bar formulation, and enhance the creaminess of the bar lather performance.

In brief, the patents mentioned above, alone or in combination, fail to teach or suggest identifying and incorporating a specific type of solid amphoteric surfactants in personal washing bars, which simultaneously accomplishes the following when compared with incorporating other types of amphoteric surfactants:

(1) dramatically improves the mixing-drying and extrusion processes;

(2) significantly improve the bar mildness when compared to other types of amphoterics incorporated in bars;

(3) improve the bar lather without negatively affecting the bar firmness.

Surprisingly and unexpectedly, applicants have found that all these goals can be simultaneously achieved by including a specific type of solid amphoteric surfactants in extruded bars. That is, by carefully selecting a solid amphoteric surfactant (i.e, with specific melting temperature or glass transition temperature ranges in the solid regime, something which is rare in the amphoteric surfactant class) and by incorporating a significant level of said amphoteric surfactant in personal washing bars, four goals are simultaneously achieved:

(1) bars containing high levels of the amphoteric surfactant can be processed using the current extrusion-stamping technology as described in the Methodology section;

(2) mixing/drying cycle is significantly reduced;

(3) skin irritation is significantly reduced when compared to formulations containing other types of amphoteric surfactants;

(4) bar hardness is not negatively affected, and lather is improved.

BRIEF SUMMARY OF THE INVENTION

Applicants have now found that incorporating a significant level of non-sticky, solid amphoteric surfactant (e.g., disodium N-lauryl iminodipropionate) into a personal washing bar composition simultaneously provides the following benefits:

(1) bars containing high levels of said amphoteric surfactants can be processed using the current extrusion-stamping technology, which is in contrast to the processing difficulties encountered when comparable levels of other types of amphoteric surfactants are included in the bars;

(2) mixing/drying cycle is significantly reduced;

(3) skin irritation is significantly reduced when compared to formulations containing other types of amphoteric surfactants;

(4) bar hardness is not negatively affected, and lather is improved.

More specifically, the subject invention comprises (A): a skin cleansing bar composition comprising (by weight percentage)

(1) about 15–97% of lathering anionic surfactants;

(2) 0–70% organic and inorganic structurants and fillers;

(3) 0–30% skin emollients and moisturizers;

(4) 0–5% hygroscopic amphoteric surfactants outside the definition of (5); and (5) 3 to 25% of a specific amphoteric surfactant which is in a solid form at a temperature range between 18° C. and 60° C.

said amphoteric surfactant is defined as a crystalline solid having a melting temperature ($T_m$) above 18° C., preferably above 20° C., and most preferably above 25° C.; or as an amorphous solid having a glass transition temperature ($T_g$) above 18° C., preferably above 20° C., and most preferably above 25° C.;

said amphoteric surfactant should contain less than 5% water, preferably less than 2% water, and most preferably less than 0.5% water.

A preferred amphoteric surfactant is disodium N-lauryl iminodipropionate. said bar composition (A) should provide a firm, non-elastic bar, which is in contrast to the elastic bars taught by U.S. Pat. No. 4,207,198 and U.S. Pat. No. 4,328,131.

A preferred processing method for said bar composition is through the extrusion process as detailed in the subject patent application, and high levels of said amphoteric surfactant (A): (5) is preferably incorporated in bars using a co-extrusion approach.

DETAILED DESCRIPTION OF THE INVENTION

Figure 1:
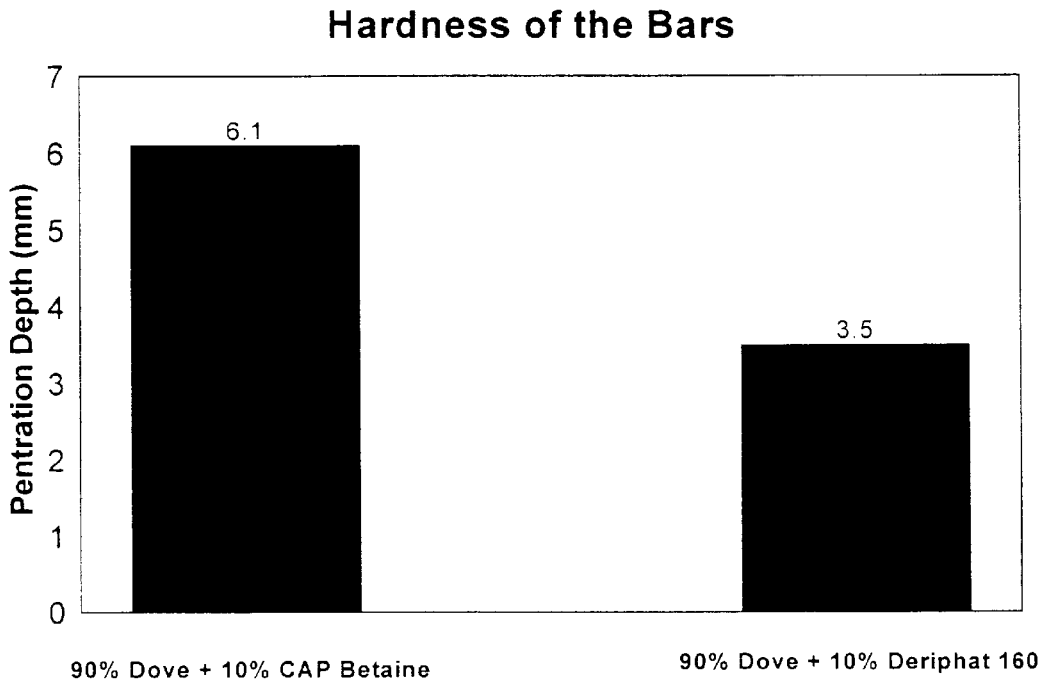
FIG. 1. shows hardness of a bar containing the solid amphoteric surfactant as defined by the invention (Deriphat 160) in comparison a bar containing a liquid, hygroscopic amphoteric surfactant (CAP betaine). Harder bars have less penetration.

Superior skin mildness has been one of the most important consumer attributes that drive the product innovations in the field of skin cleansing bars. One of the approaches used to enhance bar mildness and lather is to incorporate an amphoteric co-surfactant in the bars to mitigate the skin irritation. However, most of the amphoteric surfactants available in the market, such as cocoamidopropyl betaine, are in the form of viscous liquids or gels even at high active (low water) levels. Incorporation of high levels of such amphoteric surfactants in bars causes processing difficulties (e.g., lengthening mixing/drying time cycle, slowing down the extrusion, and causing stickiness to the stamping dies) and cause bar softness and mush. Therefore, it is desired to have an amphoteric surfactant in the low moisture, solid form to be incorporated in bars as a major ingredient. It is even more desirable if this solid amphoteric surfactant can be more effective than other types of amphoteric surfactants in reducing the skin irritation caused by the anionic surfactants in bars.

The present invention relates to novel personal washing bars prepared by using the extrusion process described in the Methodology section of the subject invention.

Unexpectedly, by incorporating a specific type of solid amphoteric surfactants (i.e., defined by the specific range of melting and glass transition temperatures) in skin cleansing bars, the following goals are met simultaneously:

(1) bars containing high levels of said amphoteric surfactants can be processed using the current extrusion-stamping technology, which is in contrast to the processing difficulties encountered when comparable levels of other types of amphoteric surfactants are included in the bars;

(2) mixing/drying cycle is significantly reduced;

(3) skin irritation is significantly reduced when compared to formulations containing other types of amphoteric surfactants;

(4) bar hardness is not negatively affected, and lather is improved.

Specifically, the inventors of the subject application identified a specific class of amphoteric surfactant, (e.g., disodium N-lauryl iminodipropionate), that simultaneously meets these needs. Formulation work shows that these materials can be processed into extruded bars at higher levels of addition without negatively affecting the bar hardness when compared with liquid or gel-like amphoterics such as cocoamidopropyl betaine. This class of amphoterics causes less shear-thinning and softening during extrusion/plodding and less sticking to the stamping die when compared to other type of amphoteric surfactants. Since disodium N-lauryl iminodipropionate, for example, is in low moisture, dry powder form, no extra amount of water is brought to the mixing. Therefore the time cycle for mixing-drying is greatly reduced, which is especially crucial to the fatty acid soap based bars. Clinical study shows that disodium N-lauryl iminodipropionate is significantly more effective than other amphoterics in mitigating the skin irritation caused by the anionic surfactants in the bars.

The percentage (%) used in the subject invention is weight percentage.

More specifically, the subject invention comprises (A): a skin cleansing bar composition comprising 1) 15 to 97%, preferably 25 to 97% of lathering anionic surfactants;

2) 3 to 25%, preferably 4 to 20%, most preferably 5 to 15% of a specific amphoteric surfactant, which is in a solid form at a temperature range between 18° C. and 60° C.

The anionic surfactant to amphoteric surfactant weight ratio should be at and above 1:1.5, preferably at and above 1:1 and most preferably at and above 2:1. Below this weight ratio, bar lather tends to be of large bubble and unstable.

The amphoteric surfactant is defined as a crystalline solid having a melting temperature ($T_m$) above 18° C., preferably above 20° C., and most preferably above 25° C.; otherwise said amphoteric surfactants is an amorphous solid having a glass transition temperature ($T_g$) above 1 8° C., preferably above 20° C., and most preferably above 25° C.

The solid amphoteric surfactant should contain less than 5% water, preferably less than 2% water, and most preferably less than 0.5% water.

The solid amphoteric surfactant should absorb 35% or less, preferably 32% or less, more preferably 30% or less, more preferably 28% or less of its own weight of water at relative humidity of 80% at temperature of 26° C.

The amphoteric surfactant is preferably disodium N-lauryl iminodipropionate;

The bar composition also contains:

1) 0–70% organic and inorganic structurants and fillers;

2) 0–30% skin emollients and moisturisers;

3) 0–5% conventional, hygroscopic amphoteric surfactants;

4) 0–20% nonionic surfactants.

The bar composition (A) provides a firm, non-elastic extrusion bar, in direct contrast to the definition to the cast melt, elastic bars taught by U.S. Pat. No. 4,207,198 and U.S. Pat. No. 4,328,131. Specifically, 2 cm thickness of said composition (A) thereof can not be pressed between a thumb and forefinger to a 1 cm thickness without permanently crushing the bar, and upon release of such pressure will not return within five seconds to within 1 mm of the 2 cm thickness.

A preferred processing method for said bar composition is through the extrusion process, which is detailed in the Methodology section of the subject patent application. High levels of said amphoteric surfactant is preferably incorporated in bars using a co-extrusion approach, as described in the Methodology section in detail.

Said bar composition (A) is hereby described in detail:

Anionic Surfactants

The anionic surfactant may be, for example, an aliphatic sulfonate, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or an aromatic sulfonate such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably between 2 and 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, and acyl isethionates.

Sulfosuccinates may be monoalkyl sulfosuccinates having the formula:

$$R^4O_2CCH_2CH(SO_3M)CO_2M;$$

amido-MEA sulfosuccinates of the formula $$R^4CONHCH_2CH_2O_2CCH_2CH(SO_3M)CO_2M$$

wherein $R^4$ ranges from $C_8$–$C_{22}$ alkyl and M is a solubilizing cation; amido-MIPA sulfosuccinates of formula $$RCONH(CH_2)CH(CH_3)(SO_3M)CO_2M$$

where M is as defined above.

Also included are the alkoxylated citrate sulfosuccinates; and alkoxylated sulfosuccinates such as the following:

$$R—O—(CH_2CH_2O)_nCOCH_2CH(SO_3M)CO_2M$$

wherein n=1 to 20; and M is as defined above.

Sarcosinates are generally indicated by the formula $$RCON(CH_3)CH_2CO_2M,$$

wherein R ranges from $C_8$–$C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl; $R^3$ ranges from $C_1$–$C_4$ alkyl and M is a solubilizing cation.

Another class of anionics are carboxylates such as follows:

$$R—(CH_2CH_2O)_nCO_2M$$

wherein R is $C_8$ to $C_{20}$ alkyl; n is 0 to 20; and M is as defined above.

Another carboxylate which can be used is amido alkyl polypeptide carboxylates such as, for example, Monteine LCQ$^{(R)}$ by Seppic.

Another surfactant which may be used are the $C_8$–$C_{24}$ fatty acid soaps (salts of alkyl carboxylate acids) having the following structure:

$$R—CO_2\ M^+$$

wherein R is a $C_8$–$C_{24}$ alkyl group, and $M^+$ is a monovalent cation such as, for example, sodium, potassium or ammonium.

Another surfactant which may be used are the $C_1$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 0.5–15% by weight of the total composition. Preferably, this component is present from about 1 to about 10%.

The acyl isethionate may be an alkoxylated isethionate such as is described in Ilardi et al., U.S. Pat. No. 5,393,466, hereby incorporated by reference into the subject application. This compound has the general formula:

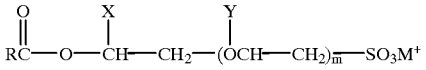

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 15 to 97% by weight of the composition, preferably 20 to 90%, most preferably 25 to 85% by weight of the composition.

Specified Solid Amphoteric Surfactants 3 to 25%, preferably 4 to 20%, most preferably 5 to 15% of a specific amphoteric surfactant, which is in a solid form at a temperature range between 18° C. and 60C, are incorporated in the bars.

Said amphoteric surfactant is defined as a crystalline solid having a melting temperature ($T_m$) above 18C, preferably above 20° C., and most preferably above 25° C.; otherwise said amphoteric surfactants is an amorphous solid having a glass transition temperature ($T_g$) below 25° C., preferably below 20° C., and most preferably below 18° C.

Said solid amphoteric surfactant should contain less than 5% water, preferably less than 2% water, and most preferably less than 0.5% water.

Said solid amphoteric surfactant should absorb 35% or less of its own weight, preferably 30% or less more preferably 28% or less, of water at a constant relative humidity of 80% at temperature of 26C.

Said solid amphoteric surfactant is preferably disodium N-Alkyl iminodialkanoate (preferably iminodipropionate) having the following molecular structure:

$$R—N—(CH_2CH_2COONa)_2$$

wherein R is preferably an alkyl functional group, preferably C10–C22, and most preferably C12–C18 alkyl functional group.

A preferred example is dialkali metal (preferably disodium) N-lauryl iminodipropionate, supplied under the tradename of Deriphat 160 by Henkel Corp.

As shown in Table 1, the hygroscopicity, measured by the amount of water absorbed (in percentage of surfactant's own weight) in three days, of disodium N-lauryl iminodipropionate is compared with those of other conventional liquid or hygroscopic amphoteric surfactants.

Table 1. Hygroscopicity of solid amphoteric surfactant in comparison with those of conventional liquid, hygroscopic amphoteric surfactants.

| Type of amphoteric surfactants | Total moisture pick-up (%) |
|---|---|
| Example: | |
| Disodium N-lauryl iminodipropionate | 26.0[1] |
| Comparatives: | |
| Coco betaine | 70.0[1] |
| Cocoamidopropyl betaine | 48.2[1] |
| Palmitylamidopropyl betaine | 46.5[1] |
| Isostearamidopropyl betaine | 44.3[1] |
| Cocoamidopropyl hydroxy sultaine | 59.5[1] |

[1]data digested from U.S. Pat. No. 5,425,892 (column 11, line 1–25)

Table 1 indicates that the comparative liquid or hygroscopic amphoteric surfactants tend to absorb significantly more water than the specified solid amphoteric surfactants used by the subject invention. Therefore, incorporation of said solid amphoteric surfactants in bars provide the following processing advantages:

1) reduction of the mixing-drying time cycle because of less water and less hygroscopicity are brought into the formulation batch;
2) less stickiness of the formulation during extrusion, chill rooling/milling and stamping stages making bars containing high levels of said solid amphoteric surfactants processible.

As shown in Examples, incorporation of said solid amphoteric surfactants into an anionic surfactant based bar formulations results in enhanced creaminess and skin feel to the bar lather during use.

Preferably, the solid is selected from the group consisting of powders, pellets, flakes and particles.

As shown in Examples, anionic surfactant to said amphoteric surfactant weight ratio should be at and above 1:1.5, preferably 1:1, and most preferably 2:1. Below this weight ratio, lather tends to be of large bubble and unstable.

Due to the solid, less hygroscopic nature of the amphoteric surfactant, said bar composition (A) provides a firm, non-elastic extrusion bar, which is in contract to the definition to the cast melt, elastic bars taught by U.S. Pat. No. 4,207,198 and U.S. Pat. No. 4,328,131. Specifically, 2 cm thickness of said composition (A) thereof can not be pressed between a thumb and forefinger to a 1 cm thickness and upon release of such pressure will not return within five seconds to within 1 mm of the 2 cm thickness.

Optional Structurants and Fillers

If the bar composition comprises synthetic anionic surfactant as the major anionic surfactant (i.e., 50% and above), said bar (A) needs to have at least 15%, preferably at least 25% more preferably at least 30%, and most preferably at least 45% of optional structurants and fillers. In contrast, if the bar composition comprises fatty acid soap as the major anionic surfactant (i.e., 50% and above), structurants and fillers are optional ingredients.

The structurant system of the invention is a mixture of water soluble alkylene oxide compounds and other structurants (i.e., fatty acid, maltodextrin and paraffin wax), wherein the alkylene oxide compounds comprise at least 20%, preferably at least 40% of said structurant system and wherein the alkylene oxide compounds further comprise no more than about 70% by wt. of total composition.

Alkylene oxide compounds include moderately high molecular weight polyalkylene oxides of appropriate melting point (e.g.,25° to 100° C., preferably 45° C. to 65° C.) and in particular polyethylene glycols or mixtures thereof.

Polyethylene glycols (PEG's) which are used may have a molecular weight in the range 2,000 to 25,000, preferably 3,000 to 10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a large quantity of other water soluble structurant such as the above mentioned polyethylene glycol of molecular weight 2,000 to 25,000, preferably 3,000 to 10,000.

Water soluble starches (e.g., maltodextrin) can also be included at levels of 1% to 15% by wt. of total composition.

Water insoluble structurants also have a melting point in the range 25–100° C., more preferably at least 45° C., notably 50° C. to 90° C. Suitable materials which are particularly envisaged are fatty acids, particularly those having a carbon chain of 12 to 24 carbon atoms. Examples are lauric, myristic, palmitic, stearic, arachidic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water soluble structurants and water insoluble structurants govern the rate at which the bar wears during use. The presence of the water-insoluble structurant tends to delay dissolution of the bar when exposed to water during use and hence retard the rate of wear.

Said skin cleansing bar also contain optional fillers selected from talc, clay, fume silica, silica, silicate, carbonates, urea, cellulose fibers, sucrose, and inorganic salts (for example, alkali metal salts such as sodium chloride), preferably hydrating electrolytes such as tetrasodium pyrophosphate, and mixtures thereof. Above fillers are especially preferred to be incorporated in the bar compositions that contain fatty acid soap as the major anionic surfactant.

Emollients and Skin Benefit Agents

Another optional ingredient is oil/emollient which may be added as a benefit agent to the bar compositions.

Various classes of oils are set forth below.

Vegetable oils: Arachis oil, castor oil, cocoa butter, coconut oil, corn oil, cotton seed oil, olive oil, palm kernel oil, rapeseed oil, safflower seed oil, sesame seed oil and soybean oil.

Esters: Butyl myristate, cetyl palmitate, decyloleate, glyceryl laurate, glyceryl ricinoleate, glyceryl stearate, glyceryl isostearate, hexyl laurate, isobutyl palmitate, isocetyl stearate, isopropyl isostearate, isopropyl laurate, isopropyl linoleate, isopropyl, myristate, isopropyl palmitate, isopropyl stearate, propylene glycol monolaurate, propylene glycol ricinoleate, propylene glycol stearate, and propylene glycol isostearate.

Animal Fats: Acytylated lanolin alcohols, lanolin, lard, mink oil and tallow.

Fatty acids and alcohols: Behenic acid, palmitic acid, stearic acid, behenyl alcohol, cetyl alcohol, eicosanyl alcohol and isocetyl alcohol.

Other examples of oil/emollients include mineral oil, petrolatum, silicone oil such as dimethyl polysiloxane, lauryl and myristyl lactate.

Alcohols include oleyl alcohol and isostearyl alcohol. Examples of ether derivatives include isosteareth or oleth carboxylic acid; or isosteareth or oleth alcohol.

Liquid fatty acids which may be used are oleic acid, isostearic acid, linoleic acid, linolenic acid, ricinoleic acid, elaidic acid, arichidonic acid, myristoleic acid and palmitoleic acid. Ester derivatives include propylene glycol isostearate, propylene glycol oleate, glyceryl isostearate, glyceryl oleate and polyglyceryl diisostearate.

Another ingredient which may be included are exfoliants such as polyoxyethylene beads, walnut shells and apricot seeds.

Optional Zwitterionic and Amphoteric Surfactants

Liquid, hygroscopic zwitterionic and amphoteric surfactants can be incorporated in extrusion bars at low levels for the purpose of lather and skin mildness enhancement. Those amphoteric and zwitterionic surfactants tend to be significantly more hygroscopic than the specified solid amphoteric surfactant used by the subject invention, as exemplified in Table 1. Those surfactants are exemplified by those which can be broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. A general formula for these compounds is:

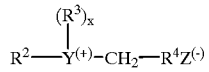

wherein $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing about 1 to about 3 carbon atoms; X is 1 when Y is a sulfur atom, and 2 when Y is a nitrogen or phosphorus atom; $R^4$ is an alkylene or hydroxyalkylene of from about 1 to about 4 carbon atoms and Z is a radical selected from the group consisting of carboxylate, sulfonate, sulfate, phosphonate, and phosphate groups.

Examples of such surfactants include:

4-[N,N-di(2-hydroxyethyl)-N-octadecylammonio]-butane-1-carboxylate;

5-[S-3-hydroxypropyl-S-hexadecylsulfonio]-3-hydroxypentane-1-sulfate;

3-[P,P-diethyl-P-3,6,9-trioxatetradexocylphosphonio]-2-hydroxypropane-1-phosphate;

3-[N,N-dipropyl-N-3-dodecoxy-2-hydroxypropylammonio]-propane-1-phosphonate;

3-(N,N-dimethyl-N-hexadecylammonio)propane-1-sulfonate;

3-(N,N-dimethyl-N-hexadecylammonio)-2-hydroxypropane-1-sulfonate;

4-[N,N-di(2-hydroxyethyl)-N-(2-hydroxydodecyl) ammonio]-butane-1-carboxylate;

3-[S-ethyl-S-(3-dodecoxy-2-hydroxypropyl)sulfonio]-propane-1-phosphate;

3-[P,P-dimethyl-P-dodecylphosphonio]-propane-1-phosphonate; and

5-[N,N-di(3-hydroxypropyl)-N-hexadecylammonio]-2-hydroxy-pentane-1-sulfate.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

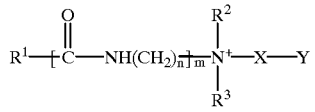

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is 2 to 4;

m is 0 to 1;

X is alkylene of 1 to 3 carbon atoms optionally substituted with hydroxyl, and

Y is —$CO_2$— or —SO—

Suitable amphoteric detergents within the above general formula include simple betaines of formula:

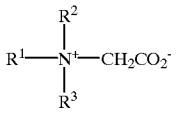

and amido betaines of formula:

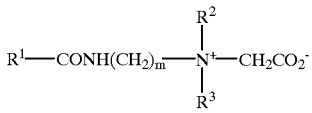

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula

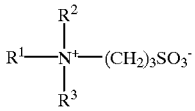

or

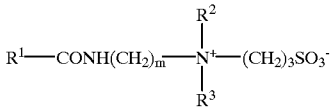

where m is 2 or 3, or variants of these in which —$(CH_2)_3SO^-_3$ is replaced by

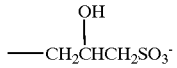

In these formulae $R^1$, $R^2$ and $R^3$ are as discussed previously.

A further possibility is that the amphoteric detergent is a sulphobetaine of formula

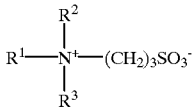

or

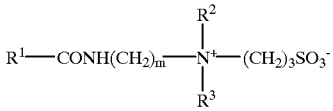

where m is 2 or 3, or variants of these in which —$(CH_2)_3SO_3^-$is replaced by

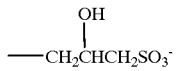

In these formulae $R^1$, $R^2$ and $R^3$ are as discussed previously.

Amphoacetates and diamphoacetates are also intended to be covered in possible zwitterionic and/or amphoteric compounds which may be used.

The optional amphoteric/zwitterionic generally comprises 0 to 5% by weight, preferably 0.1% to 4%, more preferably 0.1 to 3% by wt. of the bar composition.

Optional Nonionic Surfactants

In addition to one or more anionic and amphoteric and/or zwitterionic, the surfactant system may optionally comprise a nonionic surfactant. Preferred nonionic surfactants are selected from alkyl amine oxides, most preferably C10–C22 amine oxides.

Another optional ingredient which may be added are the deflocculating polymers such as are taught in U.S. Pat. No. 5,147,576 to Montague, hereby incorporated by reference.

In addition, the compositions of the invention may include optional ingredients as follows:

Organic solvents, such as ethanol; auxiliary thickeners, such as carboxymethylcellulose, magnesium aluminum silicate, hydroxyethylcellulose, methylcellulose, carbopols, glucamides, or Antil$^{(R)}$ from Rhone Poulenc; perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (Styrene/Acrylate copolymer); all of which are useful in enhancing the appearance or cosmetic properties of the product.

The compositions may further comprise antimicrobials such as 2-hydroxy-4,2'4' trichlorodiphenylether (DP300); preservatives such as dimethyloldimethylhydantoin (Glydant XL1 000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic conditioners which may be used include Quatrisoft LM-200 Polyquaternium-24, Merquat Plus 3330 -Polyquaternium 39; and Jaguar$^{(R)}$ type conditioners.

| Polyethylene glycols which may be used include: | | |
|---|---|---|
| Polyox | WSR-205 | PEG 14M, |
| Polyox | WSR-N-60K | PEG 45M, or |
| Polyox | WSR-N-750 | PEG 7M. |

Thickeners which may be used include Amerchol Polymer HM 1500 (Nonoxynyl Hydroethyl Cellulose); Glucam DOE 120 (PEG 120 Methyl Glucose Dioleate); Rewoderm $^{(R)}$ (PEG modified glyceryl cocoate, palmate or tallowate) from Rewo Chemicals; Antil$^{(R)}$ 141 (from Goldschmidt).

The following examples are intended to illustrate further the invention and are not intended to limit the invention in any way.

Except in operating and comparative examples or where otherwise explicitly indicated, all numbers in the description indicating amounts or ratios of materials or conditions of reaction, physical properties of materials and/or use are to be understood as modified by the word about.

Also, when used in the application, the term "comprising" should be understood to specify presence of stated features, integers, steps, components, but not to preclude presence or addition of one or more features, integers, steps, components or groups thereof.

All percentages are intended to be percentages by weight unless stated otherwise.

Methodology

Protocol of skin mildness evaluation

The Protocol of 4-Day Patch Test: Patch test was used to evaluate skin mildness of aqueous dispersions containing 1% anionic active (e.g., sodium cocoyl isethionate or Na-LED3A) and different levels of the structurant/coactives. Patches (Hilltop(R) Chambers, 25 mm in size) were applied to the outer upper arms of the panelists under bandage type dressings (Scanpor(R) tape). After each designated contact periods (24 hrs. for the first patch application, 18 hrs. for the second, third and forth day applications), the patches were removed and the sites were visually ranked in order of severity (erythema and dryness) by trained examiners under consistent lighting.

The Lather Volume Measurement: The lather performance was studied by a cylinder shaking test. Forty grams of a test solution was put in a 250ml PYREX cylinder with cap. Foam was generated by shaking the cylinder for 0.5 minute. After the foam settled for 2.5 minutes, the foam height was measured.

Bar Hardness Measurement: The hardness of the bar is measured using a cone-shaped penetrameter. The penetration depth (in mm) is measured 2 minutes after the penetrameter is released.

Art of the Formulation Processing

Bar formulations of the subject invention are designed for the route of extrusion processing that gives high throughput, high quality bars and is widely used by the bar manufacturing industry. The processing is disclosed in detail in numerous patents and books. For example, Merilyn S. Mohr reviewed the soap processing in 1989 in his book of "Art of Soap Making", and Luis Spitz reviewed the processing of both fatty acid soap bars and synthetic surfactant bars in 1996 in his book "Soap and Detergents: A Theoretical and Practical Review". Both references are hereby incorporated by reference into the subject application. The drying and finishing part of the extrusion process is briefly introduced here.

a) Mixing and drying

Bar formulations were prepared in a mixer with a sigma type blade. The components were mixed together at about 70–130° C., preferably 85–120° C., and the water level was adjusted to approximately 8–30 wt. %. The batch was covered to prevent moisture loss, and mixed until homogeneity was achieved. Then the mixture was allowed to dry (e.g., through vacuum dry, spray dry or air dry). The moisture content of the samples taken at different times during the drying stage was determined by Karl Fisher titration with a turbo titrator.

b) Chill-rolling and Milling

At the final moisture level (between approximately 2% to 20%), the formulation was dropped onto heated applicator roll and then chill rolls, or mill rolls and then was chipped into flakes or sheets.

c) Refining and plodding

The chips or sheets were plodded under vacuum in a series of refiners and plodders and extruded into noodles and then into logs. The nose cone of the plodder was heated to 45–50° C.

d) Stamping

The cut billets were stamped into bars using stampers with fixed-shaped die in place.

The bar formulation containing said solid amphoteric surfactant provides the same advantages of processing, skin mildness, and bar properties to those modified extrusion process, in which at least two or all of the following stages are involved:

1) mixing and drying;

2) refining and plodding;

3) stamping.

For example, one of the extrusion processes, the "freezer bar" process taught by U.S. Pat. Nos. 5,425,892; 5,225,098; 5,194,172, involves mixing-drying, plodding, and stamping. Therefore the "freezer bar" process is suitable and is actually a preferred processing route for the bar compositions of the subject invention.

Another preferred modified extrusion process is through coextrusion. In this process, said solid amphoteric surfactants (e.g., Deriphat 160) in the forms of powder, pellets, flakes, or particles are dry mixed with a base formulation in the solid forms as well (i.e., powder, pellets, flakes or particles). The mixture of the solids are chill-rolled or milled into chips or flakes, and then refined into new pellets and plodded into logs and stamped into bars. Alternatively, said solid amphoteric surfactants can be directly added into refiners or plodders through solid feeding devices to be co-plodded with a base bar formulation into logs and stamped into bars.

Said bar composition (A) provides the adequate bar hardness with no-elastic nature. For example, using fingers to press a bar material of 2 cm thickness to a 1 cm thickness requires extraordinary force. If achieved, the bar will result in bar cracking and irreversible damage to bar structure which can not be reversed back to 2 cm thickness upon the release of force.

EXAMPLES

Example 1 The Advantages of Using Solid Amphoteric Surfactants to the Bar Processing and Bar Hardness 10 parts by weight of solid amphoteric surfactant (i.e., Deriphat 160 by Henkel Corp.) powder was mixed with 90 parts by weight of solid flakes of Dove(R) commercial bar materials at temperatures between 40° C. and 70° C. in a sigma-blade mixer, and the mixture was milled and refined into pellets and extruded into logs. The logs then were successfully stamped into bars.

In comparison, 10 parts by weight of liquid, hygroscopic cocoamidopropyl betaine was mixed with 90 parts by weight Dove(R) commercial bar material from the same lot in a mixer at temperatures between 85° C.–120° C., and the mixture with the target moisture level (c.a. 5% of total bar composition) was dropped onto a chill roll and turned into flakes, which was sequentially refined, extruded, and stamped into bars. During this process, the formulation was noticed to be sticky and significantly reduced the extrusion throughput. The formulation was also noticed to stick to the stamping dies. Also the mixing and drying time cycle was extended due to the extra water brought in by the cocoamidopropyl betaine solution (40% active) and high hygroscopicity of the cocoamidopropyl betaine.

The hardness of the bar containing 10% Deriphat 160 was measured and compared with that of the bar containing 10% cocoamidopropyl betaine. The result shown in FIG. 1 indicates that the bar containing Deriphat 160 was significantly harder than the one containing cocoamidopropyl betaine. Finally when pressed between thumb and forefinger from 2 cm to 1 cm thickness (which required extraordinary force), the bar cracked and did not return within 5 second to within 1 mm of the original thickness of 2 cm.

Figure 2:
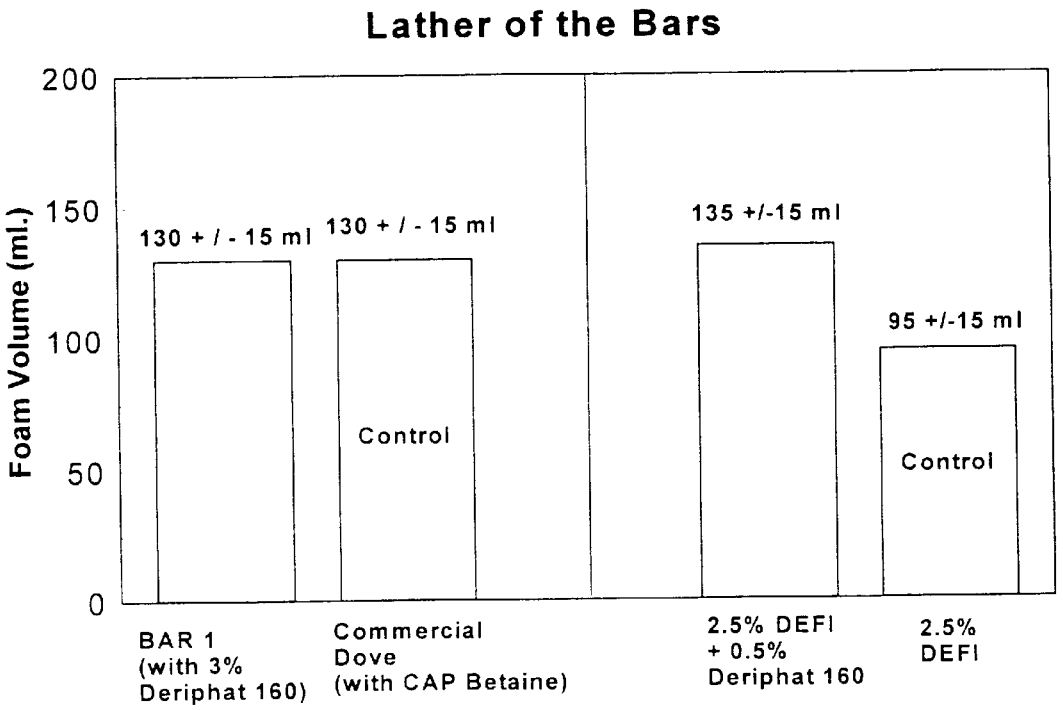
FIG. 2. shows foam volume of a bar containing solid amphoteric surfactant (Deriphat 160) in comparison with a bar containing the liquid, hygroscopic amphoteric surfactant (CAP betaine); also show are foam volume of DEFI plus Deriphat 160 in comparison with that of DEFI alone.

Example 2 Solid Amphoteric Surfactants as Lather Booster 3 parts by weight of solid amphoteric surfactant (Deriphat 160) was incorporated in 97 parts by weight of commercial Dove(R) bar materials material and successfully processed into bars using the standard extrusion process detailed in the Methodology section. The foam volume of this bar was compared with that of a Dove-based bar containing 3% cocoamidopropyl betaine. As shown in FIG. 2, these two bars have comparable lather and similar observed creaminess, indicating the solid amphoteric surfactant provides similar lather enhancement as CAP betaine does.

In a separate experiment, the lather of DEFI (a mixture of approximately 73% sodium cocoyl isethionate, 23% fatty acid, 3% sodium isethionate, and 1% water) was compared with that of a DEFI/Deriphat 160 mixture. The data shown in FIG. 2 indicated that the solid amphoteric surfactant significantly boosted the lather of DEFI and enhanced the observed lather creaminess.

Figure 3:
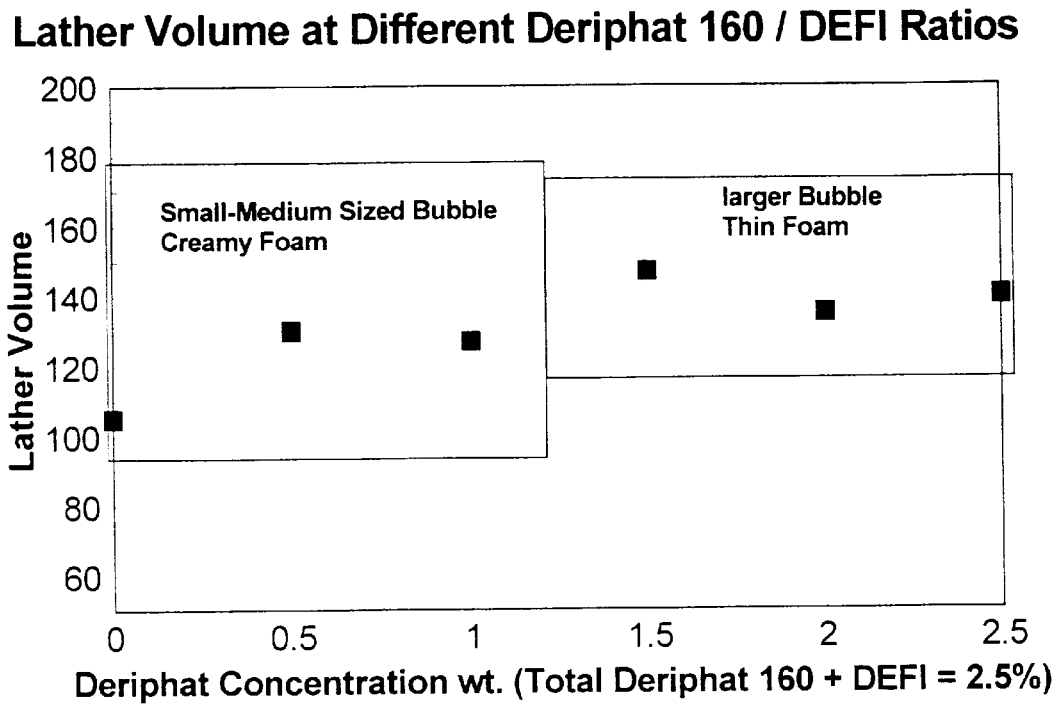
FIG. 3. Lather Volume at different DEFI/Deriphat 160 weight ratios.
Figure 4:
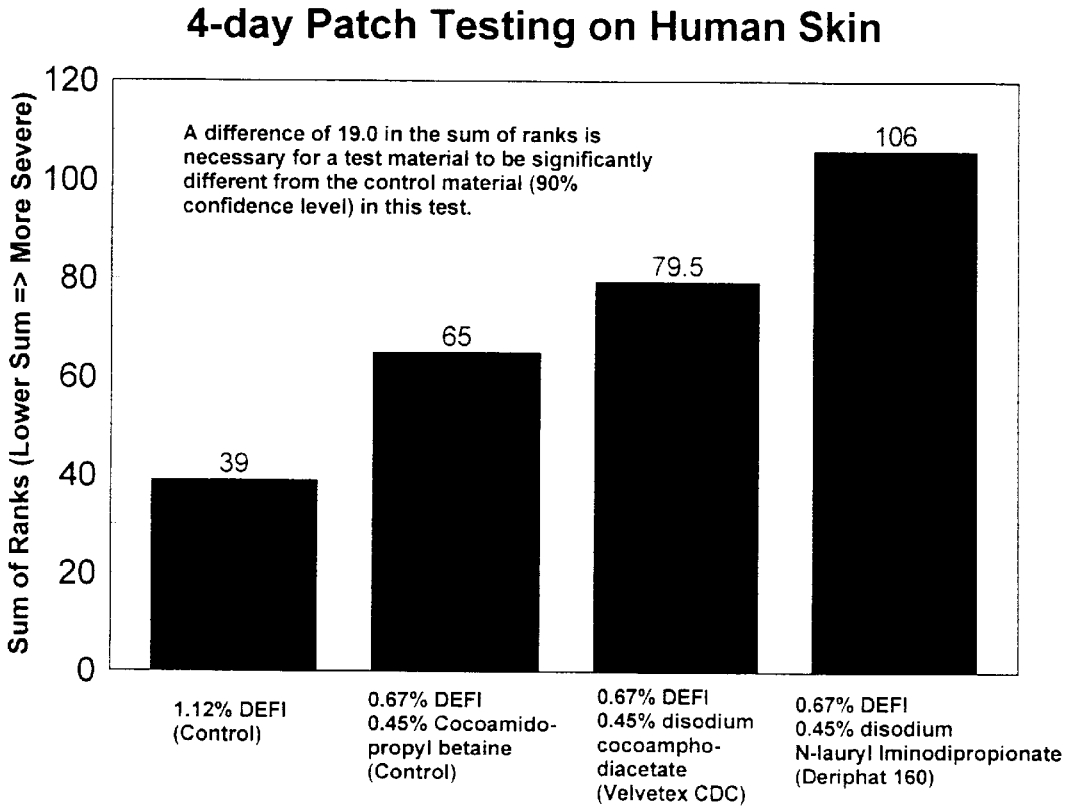
FIG. 4.4 day patch testing on human skin: DEFI/Deripaht 160 mixture in comparison with different types of DEFI/liquid, hygroscopic amphoteric surfactant mixtures and DEFI alone.

Example 3 The Anionic Surfactant to the Solid Amphoteric Surfactant Weight Ratio for the Benefit of Bar Lather Performance As shown in FIG. 3, the lather Volume at different DEFI/Deriphat 160 weight ratios was measured, and the lather creaminess was observed. The results show that the lather volume was increased by adding Deriphat 160 to DEFI. Nevertheless, below DEFI/Deriphat weight ratio of 1:1.5, the lather became coarse and less stable. Therefore, the anionic surfactant to said solid amphoteric surfactant weight ratio was set at and above 1:1.5, preferably 1:1, and most preferably 2:1 to assure that both the lather creaminess and volume improved.

Example 4 The Superior Skin Mildness of the Solid Amphoteric Surfactants for Bar Applications.

The capability of said solid amphoteric surfactants in reducing the skin irritation caused by anionic surfactants was studied by using 4 day patch testing on human skin. In this study, DEFI/Deripaht 160 mixture was compared with different types of DEFI/liquid, hygroscopic amphoteric surfactant mixtures and DEFI alone.

The results showed that the solid amphoteric surfactant (Deriphat 160) was significantly more effective in reducing the skin irritation caused by DEFI when compared with those liquid, hygroscopic amphoterics such as cocoamidopropyl betaine and disodium cocoamphodiacetate.

Example 5 The Superior Skin Mildness of the Solid Amphoteric Surfactants for Bar Applications.

Figure 5:
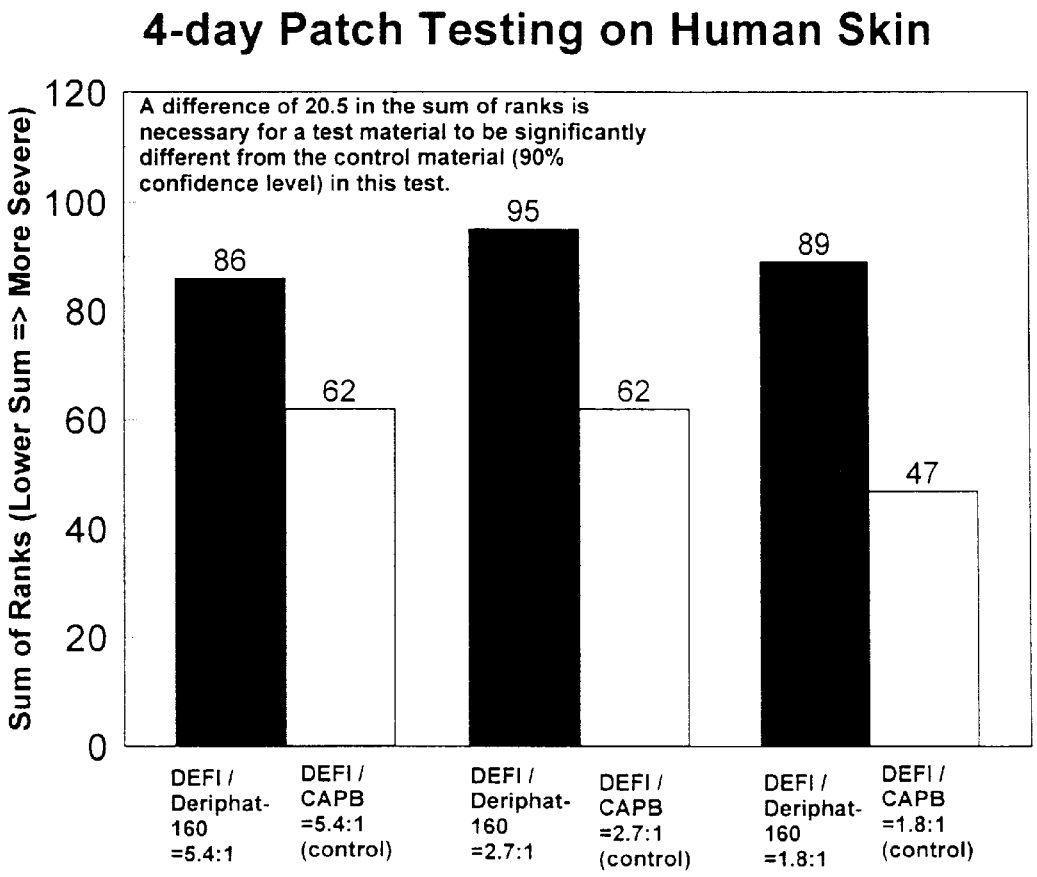
FIG. 5. 4 day patch testing on human skin: DEFI/Deriphat 160 mixture in comparison with DEFI/CAP betaine mixtures at different weight ratios.

As shown in FIG. 5, 4 day patch testing on human skin showed that DEFI/Deriphat at different weight ratios was milder to human skin than those DEFI/cocoamidopropyl betaine mixtures at the same weight ratios.

We claim:

1. A skin cleansing bar composition comprising:

(a) 15–97% of salts of alkyl carboxylates and alkali metal acyl isethionate;

(b) 3 to 25% of an amphoteric surfactant, which is a dialkali metal N-alkyl iminodialkanoate wherein the N-alkyl functional has 10 to 22 carbons, and is in a solid form at a temperature range between 180C and 60° C.;

wherein said anionic surfactant (a) to said amphoteric surfactant (b) weight ratio is at and above 1:1.5;

wherein said amphoteric surfactant, when it contains less than 5% water, is a crystalline solid having a melting temperature ($T_m$) above 18° C., or an amorphous solid having a glass transition temperature ($T_g$) above 18° C.; and wherein said solid amphoteric surfactant, when it contains less than 5% water, is capable of absorbing 35% or less of its own weight of water at relative humidity of 80% at temperature of 26° C.; and (c) 0–70% organic and inorganic structurants and fillers;

(d) 0–30% skin emollients and moisturizers;

(e) 0–5% hygroscopic amphoteric surfactants other than component (b);

(f) 0–20% nonionic surfactants;

wherein said bar composition provides a firm, non-elastic extrusion; and wherein said non-elasticity is defined in that when a 2 cm thick portion of said bar is pressed between a thumb and forefinger to a 1 cm thickness upon the release of such pressure, the portion of the bar will not return within 5 seconds to within 1 mm of the 2 cm original thickness.

2. A composition according to claim 1, wherein the anionic surfactant is between 25% and 97% of total bar composition.

3. A composition according to claim 1, wherein the amphoteric surfactant (b) is between 4% and 20% of total bar composition.

4. A composition according to claim 1, wherein the amphoteric surfactant (b) is between 5% and 15% of total bar composition.

5. A composition according to claim 1, wherein weight ratio of the anionic surfactant to the amphoteric surfactant (b) is at or greater than 1:1.

6. A composition according to claim 1, wherein weight ratio the anionic surfactant to the amphoteric surfactant (b) is at or greater than 2:1.

7. A composition according to claim 1, wherein the amphoteric surfactant (b) is a crystalline material having a melting temperature which is greater than 20° C.

8. A composition according to claim 1, wherein the amphoteric surfactant (b) is a crystalline material having a melting temperature which is greater than 25° C.

9. A composition according to claim 1, wherein the amphoteric surfactant (b) is an amorphous material having a glass transition temperature which is greater than 20° C.

10. A composition according to claim 1, wherein the amphoteric surfactant (b) is an amorphous material having a glass transition temperature which is greater than 25° C.

11. A composition according to claim 1, the amphoteric surfactant (b) used contains less than 5% water.

12. A composition according to claim 1, the amphoteric surfactant (b) used contains less than 2% water.

13. A composition according to claim 11, wherein the amphoteric surfactant (b) is capable of absorbing 32% or less of its own weight of water at relative humidity of 80% at temperature of 26° C.

14. A composition according to claim 11, wherein the amphoteric surfactant (b) is capable of absorbing 30% or less of its own weight of water at relative humidity of 80% at temperature of 26° C.

15. A composition according to claim 11, wherein the amphoteric surfactant (b) is capable of absorbing 28% or less of its own weight of water at relative humidity of 80% at temperature of 26° C.

16. A composition according to claim 1, wherein the amphoteric surfactant (b) is disodium N-alkyl iminodialkanoate wherein the N-alkyl functional has 10 to 22 carbons.

17. A composition according to claim 1, wherein the amphoteric surfactant (b) is dialkali metal N-alkyl iminodipropionate wherein the N-alkyl functional has 10 to 22 carbons.

18. A composition according to claim 1, wherein the amphoteric surfactant (b) is dialkali metal N-alkyl iminodialkanoate wherein the N-alkyl functional has 12 to 18 carbons.

19. A composition according to claim 1, wherein the amphoteric surfactant (b) is disodium N-lauryl iminodipropionate.

20. A composition according to claim 19, wherein disodium N-alkyl iminodipropionate is supplied in the solids forms selected from powders, pellets, flakes, and particles.

21. A composition according to claim 1, wherein anionic surfactants used comprise 50% or greater of synthetic anionic surfactants, and structurants and fillers (c) are 15% or greater of the total bar composition.

22. A composition according to claim 21, wherein structurants and fillers (c) are 25% or greater of the total bar composition.

23. A composition according to claim 21, wherein structurants and fillers (c) are 45% or greater of the total bar composition.

24. A composition according to claim 1, wherein fatty acid soap comprises 50% or greater of total anionic surfactants, and structurants and fillers (c) are selected from the group consisting of talc, clay, fume silica, silica, silicate, carbonates, urea, cellulose fibers, sucrose, and inorganic salts.

25. A composition according to claim 24, wherein the inorganic salt is alkali metal chloride.

26. A composition according to claim 24, wherein the inorganic salts are selected from the group consisting of hydrating electrolytes including tetrasodium pyrophosphate.

27. A composition according to claim 1, wherein hygroscopic amphoteric surfactant (e) is between 0 and 4% of the total bar composition.

28. A composition according to claim 1, wherein hygroscopic amphoteric surfactant (e) is between 0 and 3% of the total bar composition.

29. A composition according to claim 1, wherein nonionic surfactant (f) is between 0 and 10% of the total bar composition.

30. A composition according to claim 1 is prepared using an extrusion process.

31. A composition according to claim 1 is prepared using a coextrusion process.

* * * * *